US006145270A

United States Patent [19]

Hillman

[11] Patent Number: 6,145,270

[45] Date of Patent: Nov. 14, 2000

[54] PLASTICON-OPTIMIZED COMPOSITE BEAM SYSTEM

[76] Inventor: John Hillman, 1521 Lake Ave., Wilmette, Ill. 60091

[21] Appl. No.: 09/065,191

[22] Filed: Apr. 23, 1998

Related U.S. Application Data

[60] Provisional application No. 60/050,612, Jun. 24, 1997.

[51] Int. Cl.[7] ..... E04C 3/02

[52] U.S. Cl. ..... 52/731.1; 52/737.1; 52/174; 52/223.8; 52/650.1; 52/730.2; 14/6; 14/73; 14/74.5

[58] Field of Search ..... 52/87, 174, 223.8, 52/223.11, 263, 650.1, 650.2, 732.1, 730.2, 730.4, 731.1, 731.2, 737.1, 737.6, 738.1, 223.6, 223.9, 223.1; 14/6–7, 73, 73.5, 74.5

[56] References Cited

U.S. PATENT DOCUMENTS

| | | | |
|---|---|---|---|
| 865,488 | 9/1907 | Graham | 52/223.13 |
| 3,190,410 | 6/1965 | Molstad | 52/731.2 |
| 3,238,690 | 3/1966 | Wilkins | 52/731.2 X |
| 3,257,764 | 6/1966 | Cripe | 52/263 X |
| 3,906,571 | 9/1975 | Zetlin | 52/263 X |
| 4,308,700 | 1/1982 | Roming, Jr. | 52/731.2 X |
| 4,665,578 | 5/1987 | Kawada et al. | 14/74.5 |
| 5,025,522 | 6/1991 | Eskew et al. | 14/73 |

*Primary Examiner*—Carl D. Friedman
*Assistant Examiner*—Winnie Yip
*Attorney, Agent, or Firm*—Marshall, O'Toole, Gerstein, Murray & Borun

[57] ABSTRACT

A composite beam system that can be used for the framing system in bridges or buildings and provide enhanced corrosion protection includes a fiber reinforced plastic beam shell with compression and tension reinforcement. The compression reinforcement consists of portland cement concrete which is pumped into a profiled conduit within the beam shell. The conduit for the compression reinforcement is profiled to optimally resist the internal forces in the composite beam for a particular loading. The tension reinforcement consists of carbon, glass or steel fibers anchored by wrapping around the ends of the compression reinforcement. The positioning of the tension reinforcement is optimally designed to equilibrate the internal forces in the compression reinforcement. Each composite beam has a series of internal vertical stiffeners which are perpendicular to the sides of the beam shell. The composite beams can be used in the construction of bridges and buildings using conventional erection techniques. The compression reinforcement can be installed into the beam after it is erected. This results in a very light weight structural member for transportation and erection.

16 Claims, 6 Drawing Sheets

PLASTICON-OPTIMIZED COMPOSITE BEAM SYSTEM

This application claims the benefit of U.S. Provisional Application Ser. No. 60/050,612, filed Jun. 24, 1997.

TECHNICAL FIELD

This invention relates generally to bridge structures and building structures designed for pedestrian and/or vehicular traffic and more specifically to commercial and industrial framed building construction and short to medium span bridges.

BACKGROUND ART

Many or most of the short-span bridge structures in the United States are constructed of a deck surface on top of a supporting structure, most commonly a framework of steel or prestressed concrete I-beams. For example, a conventional two-span bridge (a total span of 140 feet) could have a 3" pavement wearing surface on a 7" structural slab of reinforced concrete supported on top of a framing system consisting of five longitudinal 36" steel wide flange beams or five longitudinal 45" type IV AASHTO prestressed concrete girders.

There is believed to be a significant need in the U.S. for a structural beam for use in the framework of a bridge that provides greater resistance to corrosion through the use of plastic, and that can be built not only at a competitive cost, but also with a reduction in the self weight of the structural members as it relates to transportation and erection costs. Of course plastic can also refer to fiber reinforced plastic.

It has been known that fabrication of structural elements from fiber reinforced plastics results in a structure that is less susceptible to deterioration stemming from exposure to corrosive environments. One type of structural framing member is currently manufactured using the pultrusion process. In this process, unidirectional fibers (typically glass) are pulled continuously through a metal die where they are encompassed by a multidirectional glass fabric and fused together with a thermosetting resin matrix such as vinyl ester. Although the composite structural members offer enhanced corrosion resistance, it is well known that structural shapes utilizing glass fibers have a very low elastic modulus compared to steel and very high material costs relative to both concrete and steel. As a result, pultruded structural beams consisting entirely of fiber reinforced plastic cannot be cost effectively designed and fabricated to meet the serviceability requirements, i.e. live load deflection criteria, currently mandated in the design codes for buildings and bridges.

SUMMARY OF THE INVENTION

The invention disclosed and claimed in this application provides a composite beam system that provides lighter weight for transportation and erection, enhanced corrosion resistance and in a more specific embodiment is non-conductive with respect to electrical currents.

The composite structural beam system consists of three main subcomponents. The first of these is the plastic beam shell which encapsulates the other two subcomponents. The second major subcomponent is the compression reinforcement which consists of portland cement grout or concrete which is pumped or pressure injected into a continuous conduit fabricated into the beam shell. The alignment of the conduit for the compression reinforcement is optimally designed to conform to the anticipated loadings for the beam. The third and final major subcomponent of the beam is the tension reinforcement which is used to equilibrate the internal forces in the compression reinforcing. This tension reinforcing could consist of unidirectional carbon or glass fibers or it could consist of steel fibers, e.g. standard mild reinforcing steel or prestressing strand infused in the same matrix during fabrication of the glass beam shell.

BRIEF DESCRIPTION OF THE DRAWINGS

Further advantages of the invention will become apparent upon reading the following detailed description of the invention in conjunction with the accompanying drawings, in which.

DESCRIPTION OF PREFERRED EMBODIMENT

Figure 1:
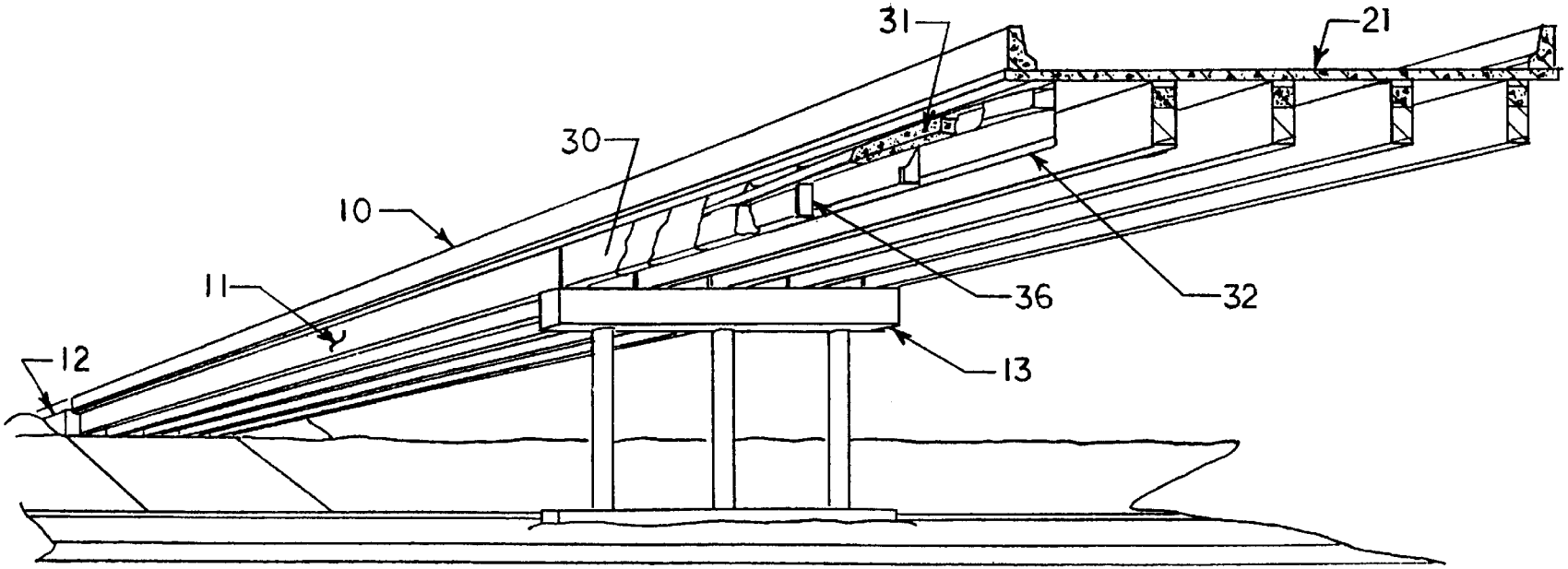
FIG. 1 is a fragmentary perspective of one embodiment of a bridge constructed using composite beams in accordance with the present invention.
Figure 2:
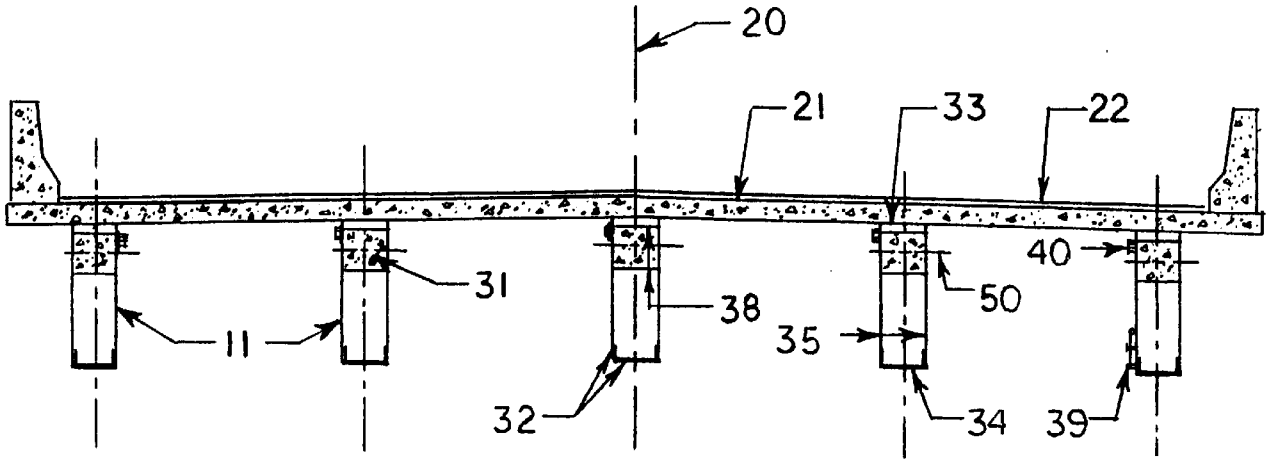
FIG. 2 is a typical cross-sectional view of the bridge shown in FIG. 1.

The bridge 10 shown in FIG. 1 is constructed of five rows of composite beams 11 spanning between bridge abutments 12 and over central pier 13. These composite beams 11 are spaced at 7'-6" intervals transversely in a symmetrical arrangement about the centerline 20 of the bridge as shown in FIG. 2. The out to out width of the bridge is 35'-0" but could be wider or narrower. For bridges which are wider or narrower, the number of beams and spacing of the beams within the cross-section could vary. The illustrated bridge 10 which consists of two spans of 70'-0" but could have more or fewer spans, and which spans could be longer or shorter, has two composite beams per row. Each composite beam 11 in a row is simply supported between an abutment and the central pier. In another embodiment, two or more girders in one row could be made continuous over the supports. For bridges with more than two spans the beams could be supported between two adjacent piers.

The deck surface includes a reinforced concrete deck slab 21 covered by, but not necessarily requiring, an overlying wearing pavement 22. The deck could be constructed out of materials other than reinforced concrete e.g. a fiber reinforced plastic deck.

Figure 9:
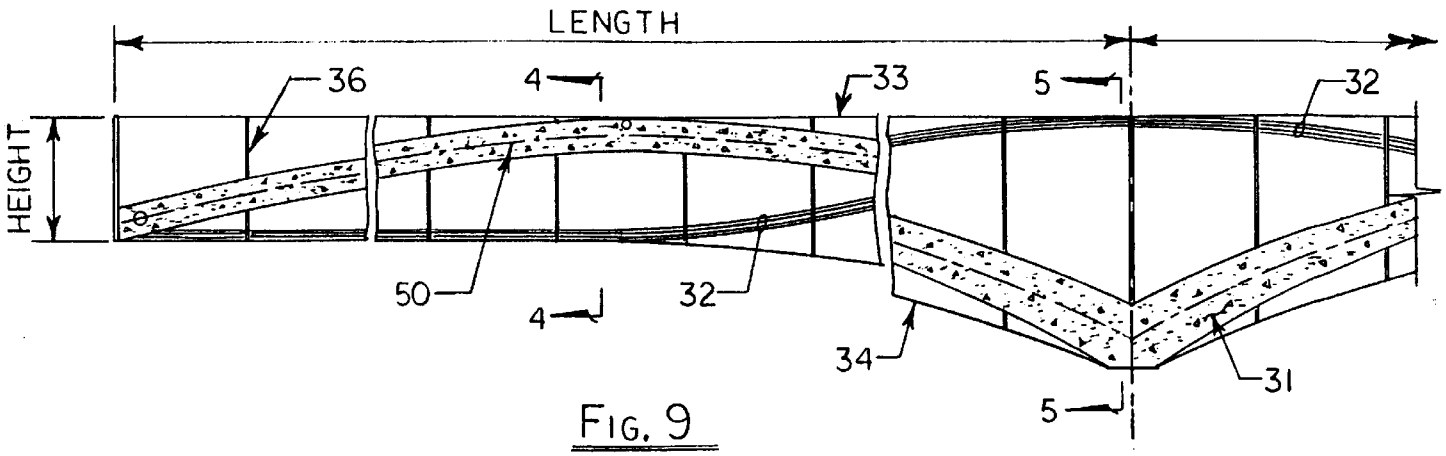
FIG. 9 is a longitudinal cross-section of a fragmentary portion of an embodiment of the beam where the height and width varies over a length of the beam.
Figure 10:
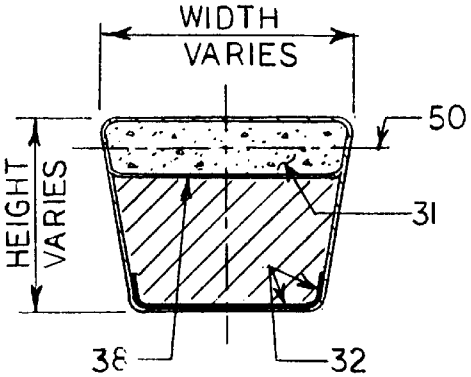
FIG. 10 is a cross-sectional view taken through line 4—4 of FIG. 9.
Figure 11:
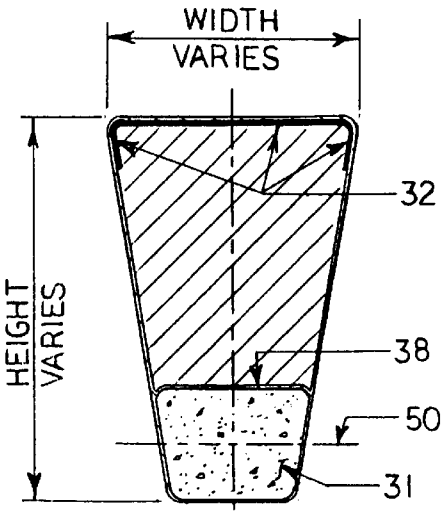
FIG. 11 is a cross-sectional view taken through line 5—5 of FIG. 9.

The composite beam 11 shown in FIG. 1 includes a plastic beam shell 30, compression reinforcement 31 and tension reinforcement 32. The illustrated composite beam has a constant height of 47" and a constant width of 16" but could be fabricated to different widths or heights and could also be constructed with the width and or height varying over the length of the beam, as illustrated in FIG. 9. The height of the composite beams in the illustrated bridge 10 results in a span to depth ratio of approximately 18:1, but could again be altered to provide different span to depth ratios.

Figure 4:
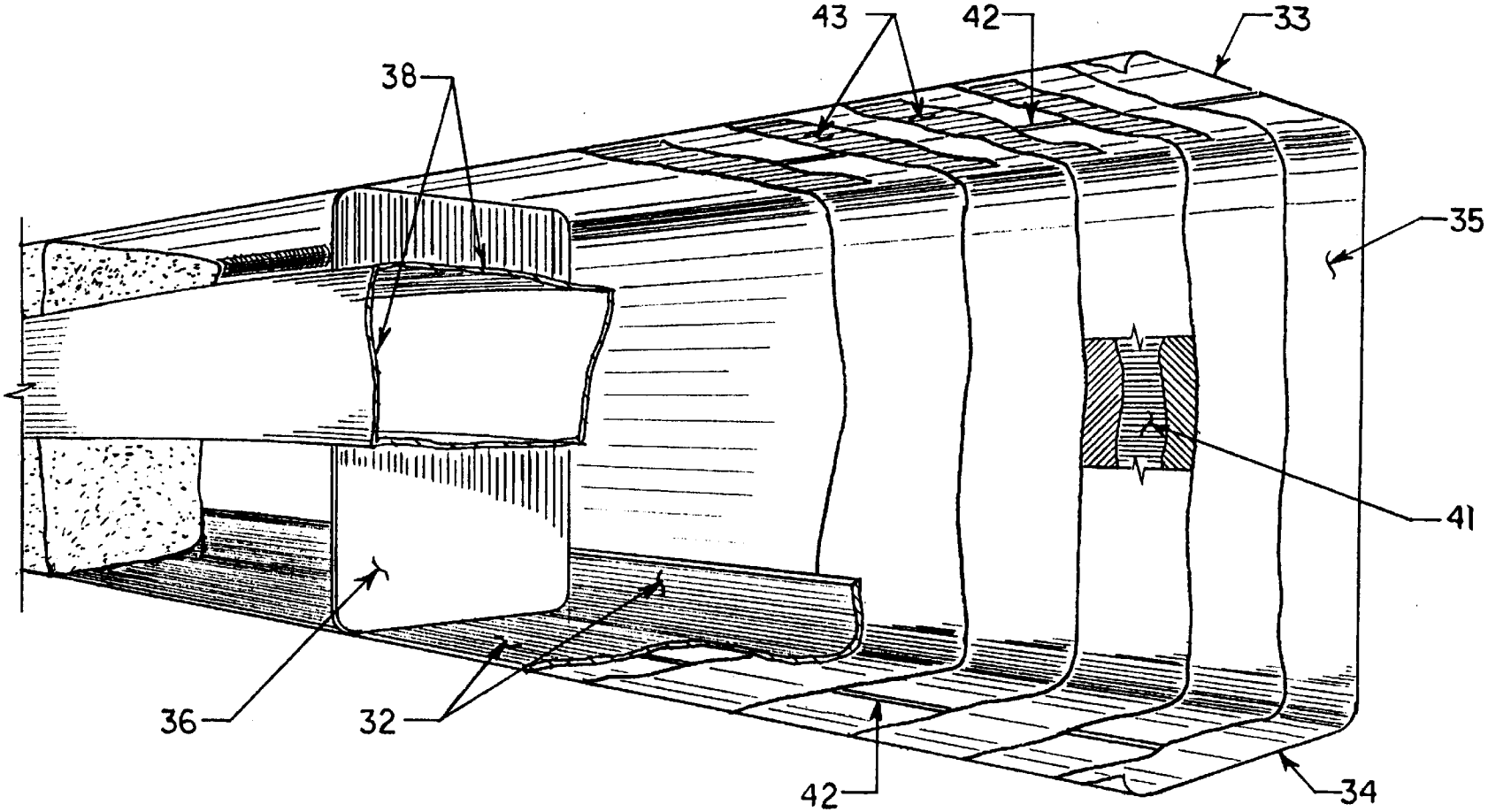
FIG. 4 is a fragmentary perspective composite beam.
Figure 7:
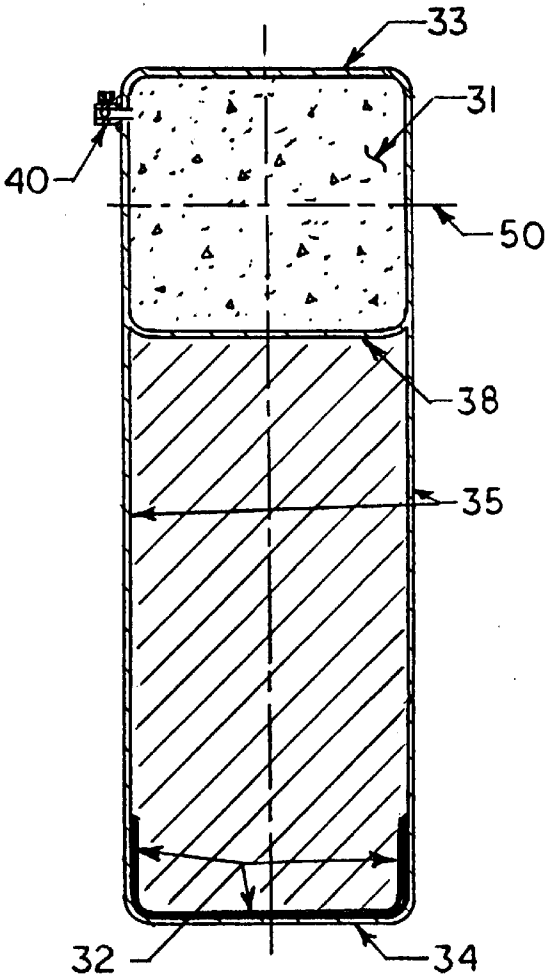
FIG. 7 is a partial sectional view taken through line 3—3 of FIG. 3.

The beam shell 30 of the composite beam is constructed of a vinyl ester resin reinforced by glass fibers optimally oriented to resist the anticipated forces in the beam. The beam could also be constructed using other types of plastic resins. The beam shell 30 includes a top flange 33, bottom flange 34, intermediate vertical stiffeners 36, two end stiffeners 37, as well as a continuous conduit 38, injection port 39 and vent ports 40 to be used for the compression reinforcement 31. The beam shell also includes a shear transfer medium 35 which serves to transfer the applied loads to the composite beam as well as to transfer the shear forces between the compression reinforcement and tension reinforcement. In the preferred embodiment the shear transfer medium 35 consists of two vertical webs, but could consist of a single or multiple webs, or it could consist of truss members interconnecting the top flange, bottom flange, compression reinforcement and tension reinforcement. All of the components of the beam shell 30 are fabricated monolithically using a vacuum assisted resin transfer method, but could be manufactured using other manufacturing processes. The shear transfer medium 35 of the beam shell is reinforced with six layers of fiberglass fabric 41 with a triaxial weave in which 65% of the fibers are oriented along the longitudinal axis of the beam and the remaining 35% of the fibers are oriented with equal amounts in plus or minus 45 degrees relative to the longitudinal axis of the beam. The fibers oriented at plus or minus 45 degrees to the longitudinal axis improve both the strength and stiffness as it relates to shear forces within the beam. The thickness of each of the two webs comprising the shear transfer medium 35 is 0.252". The shear medium 35 could also be constructed with more or fewer layers of fiberglass reinforcing and with different dimensions, proportions or orientations of the fibers. The layers of glass reinforcing fabric comprising the shear transfer medium of the beam shell extend around the perimeter of the cross section such that they also become the reinforcing for the top flange 33, bottom flange 34 and vertical end stiffener 37 of the beam shell. The perimeter of the beam shell 30 is a rectangle with the corners rounded on a 1½" radius, but could be constructed using a different shape or with radii of different dimensions. All longitudinal seams 42 of the fiberglass fabrics used in the beam shell are located within the top and bottom flanges of the beam shell. The top flange 33 of the beam shell 30 also contains 4 layers of unidirectional weave fiberglass fabric 43 located longitudinally between the layers of triaxial weave fabric 41 and which turn down at a 90 degree angle and help form the vertical end stiffener 37 of the beam shell as depicted in FIG. 4. The total thickness of the top flange 33 of the beam shell including the triaxial weave and unidirectional glass reinforcing is 0.36" but could be constructed thicker or thinner. The unidirectional fiberglass fabric 43 has 100% of the fibers oriented along the longitudinal axis of the beam. Again the top flange could obviously be constructed utilizing more or less fibers and with different proportions, orientations or composition.

Figure 3:
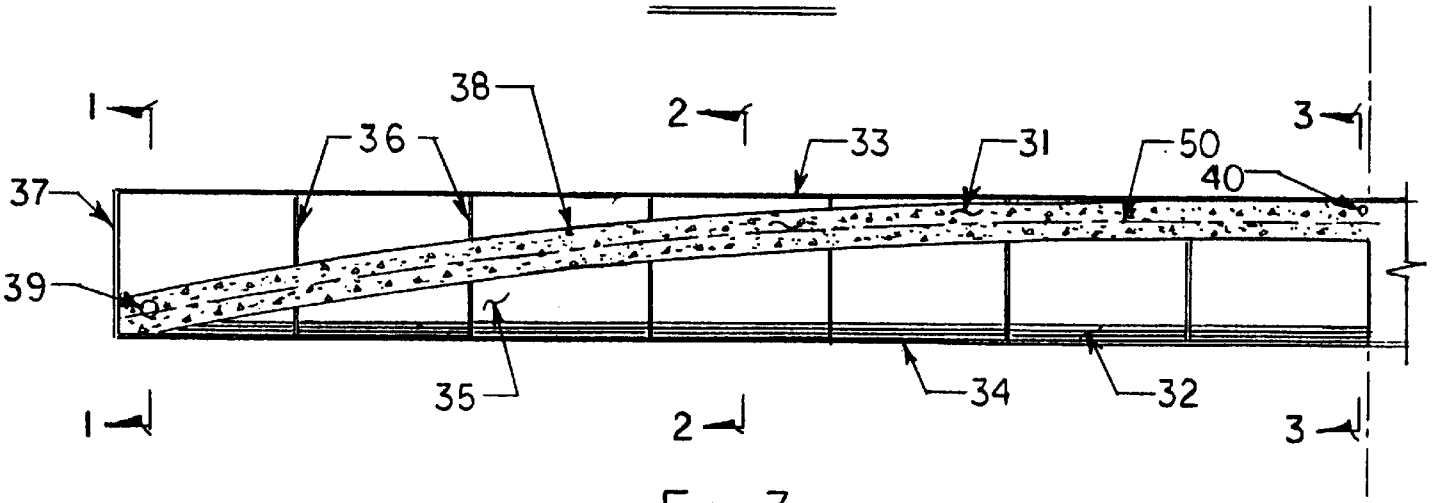
FIG. 3 is a typical side view of a composite beam of the bridge shown in FIG. 1.

Each beam shell 30 also contains intermediate vertical stiffeners 36, again consisting of glass fiber reinforced plastic. The vertical stiffeners 36, are spaced at 5'-0" longitudinal intervals along the beam shell as shown in FIG. 3, but could be spaced at different intervals. The dimensions of the vertical stiffeners are the same as the internal height and width of the beam shell 30. The reinforcing for the vertical stiffeners consist of three layers of the same triaxial weave glass fabric 41 used for the webs comprising the shear transfer medium 35, except with the 65% layer of fibers oriented along a vertical plane, perpendicular to the longitudinal axis of the composite beam. The vertical stiffeners are 0.126" thick, but could be constructed of different thicknesses. The vertical stiffeners could also be fabricated using reinforcing fabrics with different proportions, orientations or composition.

Figure 6:
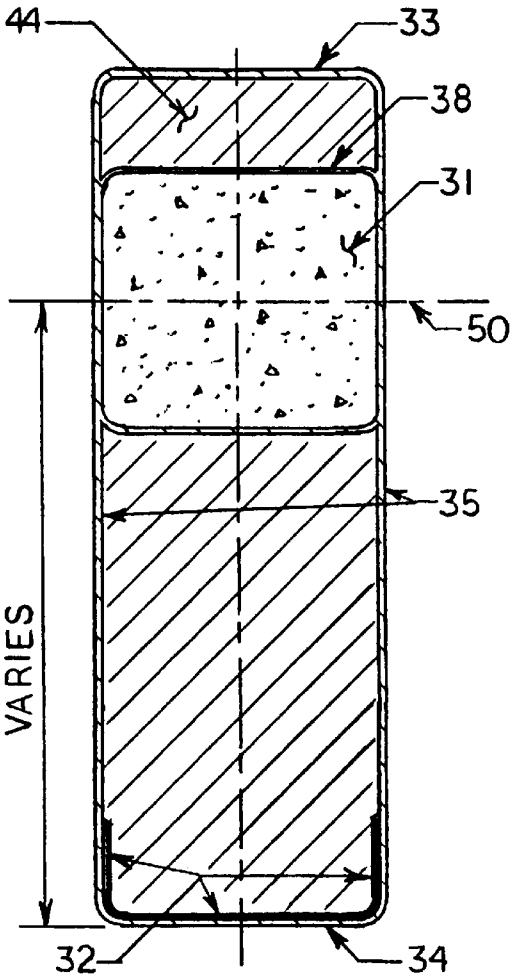
FIG. 6 is a partial sectional view taken through line 2—2 of FIG. 3.
Figure 5:
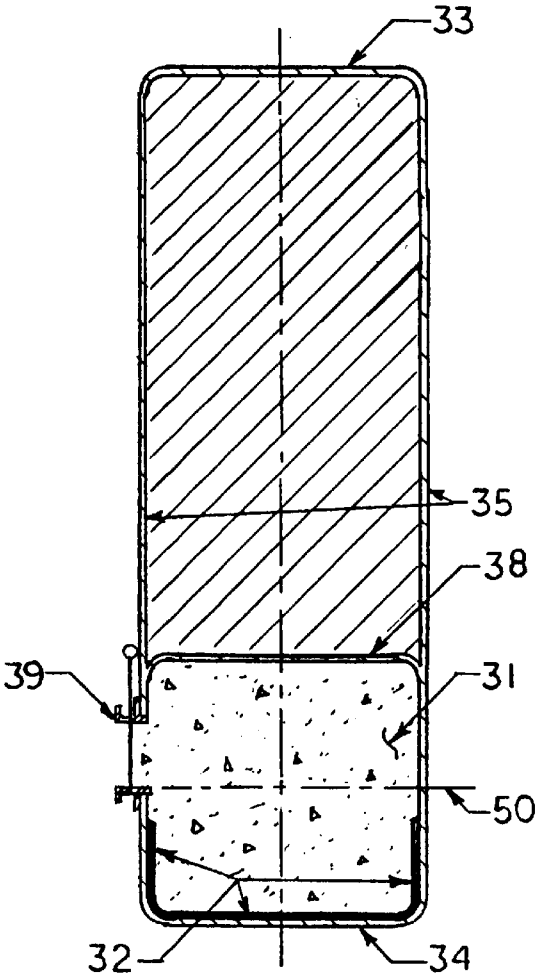
FIG. 5 is a partial sectional view taken through line 1—1 of FIG. 3.

The beam shell 30 is also fabricated with a conduit 38 which runs longitudinally and continuously between the ends of the beam along a profile designed to accommodate the compression reinforcement 31, which is described later. The conduit 38 consists of a continuous rectangular thin wall tube constructed of two layers of triaxial weave fiberglass fabric 41 as shown in FIG. 4. The intermediate stiffeners 36 are interrupted vertically by the conduit 38 passing through them, where the elevation of the interruption is a function of the profile of the compression reinforcement 31. The conduit 38 also contains an injection port 39 located along one web of the beam as depicted in FIG. 5, to be used for the introduction of the compression reinforcement. Vent ports 40 are also located at the highest and lowest points along the profile of the conduit as shown in FIG. 6. Again the conduit could be constructed using reinforcing fabrics with different proportions, orientations or compositions.

Each of the composite beams 11 includes compression reinforcement 31. The compression reinforcement 31 which consists of portland cement concrete with a compressive strength of 6,000 pounds per square inch, but could consist of portland cement grout, polymer cement concrete or polymer concrete, is introduced into the conduit within the beam shell by pumping it through the injection port 39 located in the side of the conduit. The vent ports 40 are used to ensure that no air is trapped within the conduit 38 during the placement of the compression reinforcement 31. The compression reinforcement as seen in FIG. 6 has a rectangular cross section that is 15.5" wide and 14.7" tall, but could be manufactured to larger or smaller dimensions. The profile 50 of the compression reinforcement as shown in FIG. 3 follows a path which starts at approximately 7" off of the bottom of the beam at the beam ends and varies parabolically with the highest point on the profile located at the center of the beam such that the conduit 38 is tangent to the top flange 33. The profile 50 of the compression reinforcement is designed to resist the compression and shear forces resulting from vertical loads applied to the beam in much the same manner as an arch structure, as is known in the art. The profile 50 of the compression reinforcement 31 could be constructed along a different geometric path and to different dimensions from those indicated. While the embodiment presented assumes introduction of the compression reinforcement after the beam shell has been erected, it could also be introduced during fabrication of the beam shell.

The thrust induced into the compression reinforcement resulting from externally applied loads on the composite beam is equilibrated by the tension reinforcement 32 of the composite beam 11. The tension reinforcement 32 consists of layers of unidirectional carbon reinforcing fibers with tensile strength of 160,000 pounds per square inch and an elastic modulus of 16,000,000 pounds per square inch. Although the preferred embodiment of the composite beam utilizes carbon fibers, other fibers could also be used for the tension reinforcement including glass, aramid, standard mild reinforcing steel or prestressing strand as is known in the art. The fibers which are located just above the glass reinforcing of the bottom flange 34 and along the insides of the bottom 6" of the shear transfer medium 35 as illustrated in FIG. 4, are oriented along the longitudinal axis of the composite beam. The fibers also wrap around the compression reinforcement at the ends of the beams. The tension reinforcement 32 is fabricated monolithically into the composite beam at the same time the beam shell 30 is constructed, but could also be installed by encasing conduits in the beam shell which would allow installation at a later date, or by bonding the tension reinforcement to the outside of the beam shell after fabrication. Again, the quantity, composition, orientation and positioning of the fibers in the tension reinforcement could be varied.

All composite beams within a span have the same physical geometry, composition and orientation. Benefits of the present invention could be obtained using composite beams 11 with different and or varying geometry. However use of composite beams 11 with the same physical geometry for the beam shell 30, minimizes tooling costs for fabrication due to economies of scale associated with repetition. Where several bridges are to be built, it may be possible to satisfy the load requirements of different bridges using composite beams with the same geometry for the beam shell 30, by merely changing the dimensions or profile of the compression reinforcement 31 or the quantity and dimensions of the tension reinforcement 32.

Figure 8:
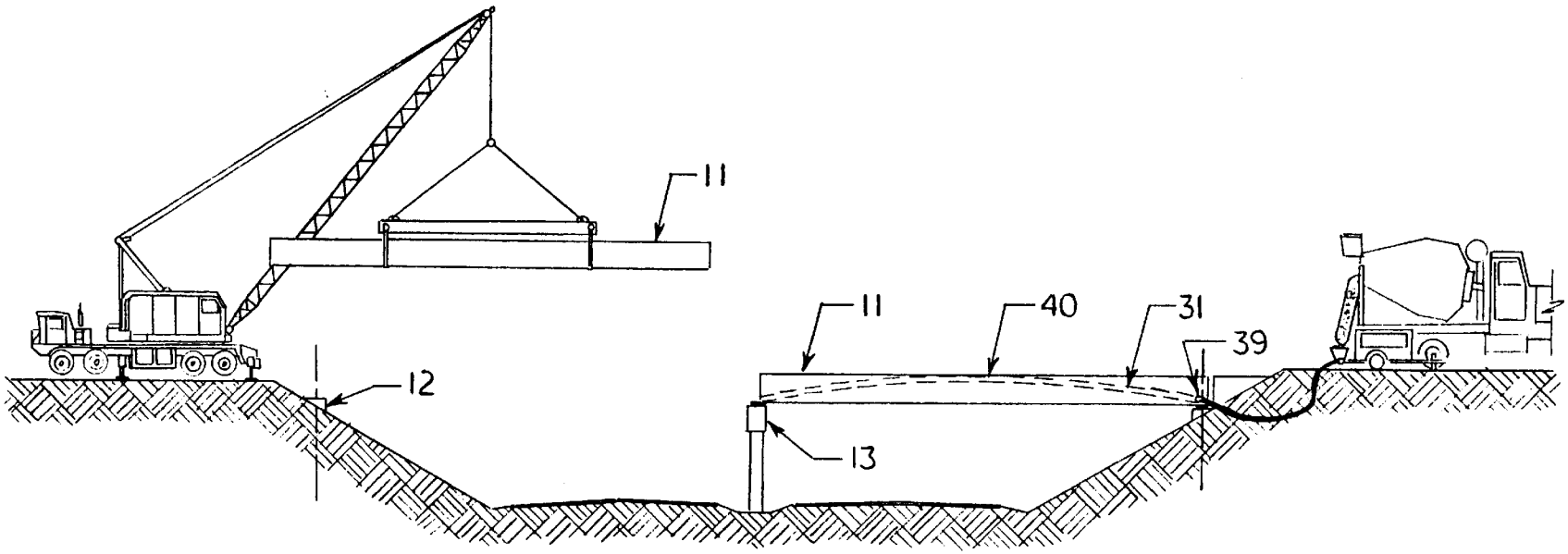
FIG. 8 is a diagrammatic view showing composite beams being placed on the substructure for the bridge shown in FIG. 1.

The illustrated bridge 10 can be built quickly and easily. The composite beams 11 are erected prior to injection of the compression reinforcement 31 by placing them with a crane (see FIG. 8) as is standard in the art. The composite beams 11 are easily self supporting prior to and during the installation of the compression reinforcement 31. In the case of bridge replacement or rehabilitation it may be possible to reuse existing abutments and/or intermediate piers. The compression reinforcement 31 is then introduced into the composite beam by injecting portland cement concrete into the profiled conduit 38 in the glass beam shell 30. The compression reinforcement 31 is injected using pumping techniques which are well known in the art. No temporary falsework is required for the erection of the composite beams 11 or during the injection of the compression reinforcing.

Once the composite beams 11 are in place and the compression reinforcement 31 has been introduced, a 7" reinforced concrete deck slab 21 is cast in place on the tops of the composite beams. The deck could also be constructed using different composition and/or different materials.

The weight of composite beams 11 during transportation and erection is approximately one fifth of the weight of the conventional steel beam required for the same span and approximately one tenth of the weight required for a precast prestressed concrete beam for the same span.

While one embodiment of the invention has been illustrated and described in detail, it should be understood this embodiment can be modified and varied for both bridge construction and building construction without departing from the scope of the following claims.

What is claimed is:

1. A construction beam useful for building bridges, commercial or industrial buildings, or the like, the beam comprising:

an elongated shell that has an interior volume;

tension reinforcement within the interior volume contributing directly to the strength of the beam;

a continuous conduit within the interior volume of the shell, said conduit having a curved profile extending along a longitudinal direction of the beam;

compression reinforcement that completely fills the interior volume of the continuous conduit, said compression reinforcement contributing directly to the strength of the beam.

2. A construction beam as recited in claim 1, in which the tension reinforcement is contained within the elongated shell.

3. A construction beam as recited in claim 1, in which the compression reinforcement is a precast concrete segment.

4. A construction beam as recited in claim 1, in which a height of the elongated shell varies over a length of the beam.

5. The construction beam as recited in claim 1, wherein the compression reinforcement was inserted into the conduit after the beam was erected.

6. The constuction beam as recited in claim 1, wherein the compression reinforcement consists of concrete.

7. The construction beam as recited in claim 1, wherein the tension reinforcement consists primarily of steel strand.

8. A construction beam useful for building bridges, commercial or industrial buildings, or the like, the beam comprising:

an elongated shell that is made of a material that is resistant to corrosion by chloride ions and has an interior volume;

tension reinforcement within the interior volume contributing directly to the strength of the beam;

a curved conduit extending along a longitudinal direction of the beam within the interior volume of the shell; and compression reinforcement that completely fills the interior volume of the conduit, said compression reinforcement contributing directly to the strength of the beam.

9. A construction beam as recited in claim 8, in which a vacuum-assisted resin transfer method is used to make the shell.

10. A construction beam as recited in claim 8, in which the shell is made predominantly of plastic.

11. A construction beam as recited in claim 8, in which the tension reinforcement is made up predominantly of steel strand.

12. The construction beam as recited in claim 8, wherein the tension reinforcement consists primarily of plastic.

13. The construction beam as recited in claim 8, wherein the compression reinforcement was inserted into the conduit after the beam was erected.

14. The construction beam as recited in claim 8, wherein 64 a height of the elongated shell varies over a length the depth of the shell varies along the length of the beam.

15. The construction beam as recited in claim 8, wherein the compression reinforcement comprises concrete.

16. A construction beam as recited in claim 1, in which a width of the enlongated shell varies over a length of the beam.

* * * * *

UNITED STATES PATENT AND TRADEMARK OFFICE

CERTIFICATE OF CORRECTION

PATENT NO. : 6,145,270

DATED : November 14, 2000

INVENTOR(S) : John Hillman

It is certified that error appears in the above-identified patent and that said Letters Patent is hereby corrected as shown below:

Claim 1, Column 9, Line 15, delete "64" between – wherein 64 a height –

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*